US010844286B2

(12) United States Patent
Kim et al.

(10) Patent No.: US 10,844,286 B2
(45) Date of Patent: Nov. 24, 2020

(54) METHOD FOR PRODUCING IMPREGNATED PITCH FROM PETROLEUM-BASED RAW MATERIAL AND IMPREGNATED PITCH PRODUCED THEREBY

(71) Applicant: Korea Research Institute of Chemical Technology, Daejeon (KR)

(72) Inventors: Jong Gu Kim, Daejeon (KR); Young-Pyo Jeon, Daejeon (KR); Ji Sun Im, Daejeon (KR); Byung Jin Song, Daejeon (KR); Byong Chol Bai, Daejeon (KR); Seung Hyun Ko, Daejeon (KR); Jong Eun Choi, Incheon (KR)

(73) Assignee: KOREA RESEARCH INSTITUTE OF CHEMICAL TECHNOLOGY, Daejeon (KR)

( * ) Notice: Subject to any disclaimer, the term of this patent is extended or adjusted under 35 U.S.C. 154(b) by 0 days.

(21) Appl. No.: 16/473,336

(22) PCT Filed: Dec. 26, 2017

(86) PCT No.: PCT/KR2017/015507
§ 371 (c)(1),
(2) Date: Jun. 25, 2019

(87) PCT Pub. No.: WO2018/124711
PCT Pub. Date: Jul. 5, 2018

(65) Prior Publication Data

US 2020/0123448 A1 Apr. 23, 2020

(30) Foreign Application Priority Data

Dec. 27, 2016 (KR) ..... 10-2016-0179775

(51) Int. Cl.
*C10C 3/04* (2006.01)
*C10C 3/06* (2006.01)
*C10C 3/00* (2006.01)

(52) U.S. Cl.
CPC ..... *C10C 3/04* (2013.01); *C10C 3/002* (2013.01); *C10C 3/06* (2013.01)

(58) Field of Classification Search
None
See application file for complete search history.

(56) References Cited

U.S. PATENT DOCUMENTS

| | | | | |
|---|---|---|---|---|
| 4,575,412 A * | 3/1986 | Yudate | C10C 1/19 | 208/40 |
| 7,318,890 B1 * | 1/2008 | Malone | C10C 3/06 | 208/131 |
| 2015/0076031 A1 * | 3/2015 | Zhao | C10G 3/50 | 208/40 |

FOREIGN PATENT DOCUMENTS

| | | | |
|---|---|---|---|
| JP | 61215692 | A | 9/1986 |
| JP | 8120282 | A | 5/1996 |
| JP | 8134468 | A | 5/1996 |
| JP | 2546801 | B2 | 10/1996 |
| KR | 19880001542 | B1 | 8/1988 |
| KR | 1019930005526 | B1 | 6/1993 |

OTHER PUBLICATIONS

English Translation of PCT International Search Report dated Mar. 30, 2018, from which the instant application is based, 2 pgs.

* cited by examiner

*Primary Examiner* — Tam M Nguyen
(74) *Attorney, Agent, or Firm* — Fredrikson & Byron, P.A.

(57) ABSTRACT

The present invention relates to a method for producing an impregnated pitch from a petroleum-based raw material and to an impregnated pitch produced using the same, and when the method for producing an impregnated pitch according to the present invention is used, it is possible to produce an impregnated pitch having a high carbonization yield (40 wt % or more) and low quinoline insoluble matter (QI, 2% or less) for improving efficiency of an impregnation process from a petroleum-based raw material. Therefore, when an impregnation process is applied to a carbon compact by using the impregnated pitch according to the present invention, it is possible to remarkably reduce micropores inside the carbon compact, and to produce a carbon compact having physical properties such as excellent electrical conductivity and mechanical strength.

9 Claims, No Drawings

METHOD FOR PRODUCING IMPREGNATED PITCH FROM PETROLEUM-BASED RAW MATERIAL AND IMPREGNATED PITCH PRODUCED THEREBY

RELATED APPLICATIONS

This application is a 35 U.S.C. 371 national stage filing from International Application No. PCT/KR2017/015507, filed Dec. 26, 2017, which claims priority to Korean Application No. 10-2016-0179775, filed Dec. 27, 2016, the teachings of which are incorporated herein by reference.

BACKGROUND OF THE INVENTION

1. Field of the Invention

The present invention relates to a method for producing an impregnated pitch from a petroleum-based raw material and to an impregnated pitch produced using the same.

2. Description of the Related Art

In general, petroleum-based low-grade raw materials (PFO, NCB-Oil, FCC-DO, VR etc.) are obtained as a by-product of a petroleum refining process, which are mostly used as a low-priced fuel for ships and power generation facilities due to their low utility value. However, the above mentioned materials contain plenty of aromatic compounds, suggesting that they can easily form a carbon structure. Therefore, various studies to convert them into value-added products thereof are undergoing.

An impregnated pitch is a raw material for impregnation processing to enhance properties of synthetic graphites (or artificial graphites) such as increasing density and strength. The impregnated pitches are required to have properties both high mobility and coking value; the high mobility for the impregnation into micro/nano pores and the high coking value to enhance the properties of synthetic graphite after the graphitization heat treatment.

A binder pitch is a raw material used for the preparation of artificial graphites, carbon compacts and graphite compacts; it is blended with fine carbon or cokes through the kneading process, and then form into graphite block or graphite electrode after the heat treatments.

When a carbon compact (green body) produced (molded) from cokes or graphite powder and a binder pitch is heat-treated, some of organic materials are evaporated so that micropores are formed in the compact. These micropores adversely affect physical properties of the electrode, block, and the high temperature materials which require excellent electrical conductivity and mechanical strength. So, in order to prepare a carbon compact having desirable physical properties, such processes as impregnation and recarbonization are necessarily repeated using not a binder pitch but an impregnated pitch to reduce pores.

Conventionally, coal-based raw materials such as coal tar have been used as a raw material for producing an impregnated pitch. Patent Reference 1 describes a method for preparing an improved coal tar pitch having a low solid content by high temperature oxidation of coal tar distillates using air or oxygen and an impregnated coal tar pitch prepared by the same. However, such an impregnated pitch based on coal-based raw materials such as coal tar has a problem of a high QI value.

In the meantime, the conventional petroleum-based pitch has a lower QI value than the coal tar pitch (coal-based pitch), but is difficult to apply to impregnation process due to its low carbonization yield (fixed carbon, coking value, carbon residue, coking value, fixed carbon, etc.). This characteristic is due to the difference in chemical composition of the coal tar (petroleum-based) pitch and the petroleum-based pitch. Petroleum-based raw materials contain higher aliphatic components and higher low boiling point component ratio than coal-based raw materials, so that the petroleum-based raw material displays low yield in the process of heat treatment (calcination, carbonization, etc.) at high temperature (generally 900° C. or higher). Therefore, if this disadvantage of the petroleum-based pitch can be overcome to improve the density required in the impregnation process, a high quality petroleum-based impregnated pitch having a significantly lower QI value than the conventional coal-based raw material can be prepared.

Thus, the present inventors have studied a method for producing an impregnated pitch from a petroleum-based raw material. In the course of the study, it has been found that a pitch having a low QI value and a high carbonization yield can be prepared when an impregnated pitch is prepared by using a heat-treatment based pitch polymerization method designed based on the changes in the process conditions of temperatures and pressures, leading to the completion of the present invention.

PRIOR ART REFERENCE

Patent Reference (Patent Reference 1) Korean Patent No. 1988-0001542

SUMMARY OF THE INVENTION

It is an object of the present invention to provide a method for producing an impregnated pitch from a petroleum-based raw material.

It is another object of the present invention to provide an impregnated pitch prepared by the method above.

To achieve the above objects, the present invention provides a method for producing an impregnated pitch comprising the following steps:

heat-treating a petroleum-based raw material in an inert gas atmosphere under the pressure of 10~40 bar (step 1);

heat-treating the petroleum-based raw material which had been heat-treated in step 1 at normal pressure (step 2); and distillating the petroleum-based raw material which had been heat-treated in step 2 under reduced pressure (step 3).

Advantageous Effect

When the method for producing an impregnated pitch according to the present invention is used, it is possible to produce an impregnated pitch having a high carbonization yield (40 wt % or more) and a low QI value (2% or less) for improving efficiency of an impregnation process from a petroleum-based raw material. Therefore, when an impregnation process is applied to a carbon compact by using the impregnated pitch according to the present invention, it is possible to remarkably reduce micropores inside the carbon compact, and to produce a carbon compact having physical properties such as excellent electrical conductivity and mechanical strength.

DESCRIPTION OF THE PREFERRED EMBODIMENTS

Hereinafter, the present invention is described in detail.

The present invention provides a method for producing an impregnated pitch comprising the following steps:

heat-treating a petroleum-based raw material in an inert gas atmosphere under the pressure of 10~40 bar (step 1);

heat-treating the petroleum-based raw material which had been heat-treated in step 1 at normal pressure (step 2); and distillating the petroleum-based raw material which had been heat-treated in step 2 under reduced pressure (step 3).

Hereinafter, the method for producing an impregnated pitch is described in more detail step by step.

First, step 1 is to heat-treat a petroleum-based raw material in an inert gas atmosphere under a high-pressure condition.

The purpose of this step is to induce cracking of a petroleum-based low grade raw material component. The petroleum-based low grade raw material used as a raw material in this invention is a mixture composed of polyaromatic hydrocarbons, so that it is easy to generate insoluble matters having cokes and crystals in a high temperature heat treatment process. Therefore, in order to inhibit the production of quinoline insoluble matter (QI) in the pitch which is a target product of the present invention, cracking of the components forming a petroleum-based low grade raw material is induced via pressurized heat-treatment in this step.

The petroleum-based raw material above is exemplified by pyrolyzed fuel oil (PFO), naphtha cracking bottom oil (NCB), ethylene cracker bottom oil (EBO), vacuum residue (VR), de-asphalted oil (DAO), atmospheric residue (AR), FCC-DO (fluid catalytic cracking decant oil), RFCC-DO (residue fluid catalytic cracking decant oil) and heavy aromatic oil, and any conventional petroleum-based raw material generally used in this field can be used without limitation.

In this step, the inert gas is exemplified by be nitrogen, helium, neon or argon, and any conventional inert gas generally used in this field can be used without limitation.

In this step, the pressure condition is preferably between 10 bar and 40 bar, but it can be adjusted between 5 bar and 60 bar according to the purpose of the pitch and the kind of the raw material.

In this step, the heat treatment can be performed at the temperature between 300° C. and 450° C. and preferably performed at the temperature between 350° C. and 400° C.

In this step, the heat treatment can be performed for 0.5~10 hours, preferably performed for 1~8 hours, and more preferably performed for 1~5 hours.

Next, step 2 is to heat-treat the petroleum-based raw material heat-treated in step 1 once again at normal pressure.

The purpose of this step is to induce polymerization of aromatic components of the petroleum-based raw material and to discharge volatile components and non-reactive components such as paraffins having a low boiling point. In this step, the reaction is induced at normal pressure, so that all the gas generated in the course of the heat treatment is discharged out of the reactor. At this time, the normal pressure indicates a range of atmospheric pressure generally used, more particularly a pressure in the range of 1 bar±10%. In addition, the pressure range is not limited to the above and this step can be performed at atmospheric condition of the ambient environment in which the method according to the present invention is conducted.

In this step, the heat treatment can be performed at the temperature between 300° C. and 450° C. and preferably performed at the temperature between 350° C. and 400° C.

In this step, the heat treatment can be performed for 0.5~10 hours, preferably performed for 1~8 hours, and more preferably performed for 1~5 hours.

Finally, step 3 is to distillate the petroleum-based raw material heat-treated in step 2 under reduced pressure.

This step is a step of controlling the carbonization yield and the QI value of the intermediate pitch produced in step 2. The carbonization yield of the final impregnated pitch can be increased by removing volatile components of the intermediate pitch produced in step 2. The reason for performing the distillation under the reduced pressure condition lower than the pressure in step 2 and the temperature condition lower than the temperature in step 2 is to suppress the generation of QI and to induce the discharge of volatile components in the pitch. If the reaction is induced at a temperature higher than the temperature proposed in step 2, QI would be generated due to the polymerization reaction of the hydrocarbon components in the pitch.

In this step, the pressure condition is approximately 0.08 hPa, preferably 0.01~0.1 hPa, and more preferably 0.01~1.00 hPa.

In this step, the distillation under reduced pressure can be performed at the temperature between 100° C. and 250° C. and preferably performed at the temperature between 150° C. and 200° C.

In this step, the distillation under reduced pressure can be performed for 0.5~10 hours, preferably performed for 1~8 hours, and more preferably performed for 1~5 hours.

The present invention also provides an impregnated pitch prepared by the method for producing an impregnated pitch of the present invention.

At this time, the impregnated pitch can have a QI value of 5% or less, a QI value of 3% or less, a QI value of 2% or less, a QI value of 1.5% or less, a QI value of 1.0% or less, a QI value of 0.5% or less, a QI value of 0.3% or less, a QI value of 0.2% or less, a QI value of 0.1% or less, a QI value of 0.05% or less, and a QI value of 0.01% or less.

In addition, the impregnated pitch can have a carbonization yield of 40%~45%, preferably a carbonization yield of 45%~50%, and more preferably a carbonization yield of 50%~55%.

The impregnated pitch prepared according to the method for producing an impregnated pitch of the present invention has as low QI as 2% or less and as high carbonization yield as 40% or more, so that when a carbon compact is prepared by using the impregnated pitch of the present invention, it is possible to reduce micropores inside the carbon compact, and to produce a carbon compact having physical properties such as excellent electrical conductivity and mechanical strength.

Practical and presently preferred embodiments of the present invention are illustrative as shown in the following Examples.

However, it will be appreciated that those skilled in the art, on consideration of this disclosure, may make modifications and improvements within the spirit and scope of the present invention.

Example 1: Preparation of Impregnated Pitch Using the Method According to the Present Invention 1

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 3 hours.

Step 2: The pyrolyzed fuel oil (PFO) heat-treated in step 1 was loaded in the autoclave reactor, followed by heat-treatment at 370° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 1 hour, and as a result 457 g of a impregnated pitch was obtained.

Example 2: Preparation of Impregnated Pitch Using the Method According to the Present Invention 2

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 330° C. under the pressure of 15 bar for 3 hours.

Step 2: The pyrolyzed fuel oil (PFO) heat-treated in step 1 was loaded in the autoclave reactor, followed by heat-treatment at 370° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 1 hour, and as a result 482 g of a impregnated pitch was obtained.

Example 3: Preparation of Impregnated Pitch Using the Method According to the Present Invention 3

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 410° C. under the pressure of 15 bar for 3 hours.

Step 2: The pyrolyzed fuel oil (PFO) heat-treated in step 1 was loaded in the autoclave reactor, followed by heat-treatment at 370° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 1 hour, and as a result 429 g of a impregnated pitch was obtained.

Example 4: Preparation of Impregnated Pitch Using the Method According to the Present Invention 4

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 1 hour.

Step 2: The pyrolyzed fuel oil (PFO) heat-treated in step 1 was loaded in the autoclave reactor, followed by heat-treatment at 370° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 1 hour, and as a result 487 g of a impregnated pitch was obtained.

Example 5: Preparation of Impregnated Pitch Using the Method According to the Present Invention 5

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 5 hours.

Step 2: The pyrolyzed fuel oil (PFO) heat-treated in step 1 was loaded in the autoclave reactor, followed by heat-treatment at 330° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 1 hour, and as a result 446 g of a impregnated pitch was obtained.

Example 6: Preparation of Impregnated Pitch Using the Method According to the Present Invention 6

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 3 hours. Step 2: The pyrolyzed fuel oil (PFO) heat-treated in step 1 was loaded in the autoclave reactor, followed by heat-treatment at 330° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 1 hour, and as a result 490 g of a impregnated pitch was obtained.

Example 7: Preparation of Impregnated Pitch Using the Method According to the Present Invention 7

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 3 hours.

Step 2: The pyrolyzed fuel oil (PFO) heat-treated in step 1 was loaded in the autoclave reactor, followed by heat-treatment at 410° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 1 hour, and as a result 440 g of a impregnated pitch was obtained.

Example 8: Preparation of Impregnated Pitch Using the Method According to the Present Invention 8

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 3 hours.

Step 2: The pyrolyzed fuel oil (PFO) heat-treated in step 1 was loaded in the autoclave reactor, followed by heat-treatment at 370° C. under the pressure of 1 bar for 1 hour.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 1 hour, and as a result 475 g of a impregnated pitch was obtained.

Example 9: Preparation of Impregnated Pitch Using the Method According to the Present Invention 9

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 3 hours.

Step 2: The pyrolyzed fuel oil (PFO) heat-treated in step 1 was loaded in the autoclave reactor, followed by heat-treatment at 370° C. under the pressure of 1 bar for 5 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 1 hour, and as a result 444 g of a impregnated pitch was obtained.

Example 10: Preparation of Impregnated Pitch Using the Method According to the Present Invention 10

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 3 hours.

Step 2: The pyrolyzed fuel oil (PFO) heat-treated in step 1 was loaded in the autoclave reactor, followed by heat-treatment at 370° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 170° C. under the pressure of 0.08 hPa for 1 hour, and as a result 474 g of a impregnated pitch was obtained.

Example 11: Preparation of Impregnated Pitch Using the Method According to the Present Invention 11

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 3 hours.

Step 2: The pyrolyzed fuel oil (PFO) heat-treated in step 1 was loaded in the autoclave reactor, followed by heat-treatment at 370° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 230° C. under the pressure of 0.08 hPa for 1 hour, and as a result 451 g of a impregnated pitch was obtained.

Example 12: Preparation of Impregnated Pitch Using the Method According to the Present Invention 12

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 3 hours.

Step 2: The pyrolyzed fuel oil (PFO) heat-treated in step 1 was loaded in the autoclave reactor, followed by heat-treatment at 370° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for 2 hours, and as a result 452 g of a impregnated pitch was obtained.

Example 13: Preparation of Impregnated Pitch Using the Method According to the Present Invention 13

An impregnated pitch was prepared using the method according to the present invention comprising the following steps 1, 2 and 3.

Step 1: 1000 g of pyrolyzed fuel oil (PFO), a petroleum-based low grade raw material, was loaded in an autoclave reactor, followed by heat-treatment at 370° C. under the pressure of 15 bar for 3 hours.

Step 2: The pyrolyzed fuel oil (PFO) heat-treated in step 1 was loaded in the autoclave reactor, followed by heat-treatment at 370° C. under the pressure of 1 bar for 3 hours.

Step 3: The pyrolyzed fuel oil (PFO) heat-treated in step 2 was loaded in a thin layer distillation (TLD) reactor, followed by distillation under reduced pressure at 200° C. under the pressure of 0.08 hPa for minutes, and as a result 470 g of a impregnated pitch was obtained.

Pressure, temperature and time conditions of each step of Examples 1~3 are summarized in Table 1 below.

TABLE 1

| | Step 1 (pressurization) | | | Step 2 (normal pressure) | | | Step 3 (reduced pressure) | | |
|---|---|---|---|---|---|---|---|---|---|
| | pressure (Bar) | temperature (° C.) | time (H) | pressure (Bar) | temperature (° C.) | time (H) | pressure (Bar) | temperature (° C.) | time (H) |
| Example 1 | 15 | 370 | 3 | 1 | 370 | 3 | 0 | 200 | 1 |
| Example 2 | | 330 | 3 | | 370 | 3 | | 200 | 1 |
| Example 3 | | 410 | 3 | | 370 | 3 | | 200 | 1 |
| Example 4 | | 370 | 1 | | 370 | 3 | | 200 | 1 |
| Example 5 | | 370 | 5 | | 370 | 3 | | 200 | 1 |

TABLE 1-continued

| | Step 1 (pressurization) | | | Step 2 (normal pressure) | | | Step 3 (reduced pressure) | | |
|---|---|---|---|---|---|---|---|---|---|
| | pressure (Bar) | temperature (° C.) | time (H) | pressure (Bar) | temperature (° C.) | time (H) | pressure (Bar) | temperature (° C.) | time (H) |
| Example 6 | | 370 | 3 | | 330 | 3 | | 200 | 1 |
| Example 7 | | 370 | 3 | | 410 | 3 | | 200 | 1 |
| Example 8 | | 370 | 3 | | 370 | 1 | | 200 | 1 |
| Example 9 | | 370 | 3 | | 370 | 5 | | 200 | 1 |
| Example 10 | | 370 | 3 | | 370 | 3 | | 170 | 1 |
| Example 11 | | 370 | 3 | | 370 | 3 | | 230 | 1 |
| Example 12 | | 370 | 3 | | 370 | 3 | | 200 | 2 |
| Example 13 | | 370 | 3 | | 370 | 3 | | 200 | 0.5 |

Experimental Example 1: Analysis of Physical Properties of Impregnated Pitches According to the Present Invention The physical properties of the impregnated pitches prepared in Examples 1~13 according to the present invention were analyzed.

1. Analysis of Quinoline Insoluble Matter (QI) of the Impregnated Pitches Prepared in Examples 1~13

QI values of the impregnated pitches prepared in Examples 1~13 were measured based on ASTM D2318.

2. Analysis of Carbonization Yield of the Impregnated Pitches Prepared in Examples 1~13

Carbonization yields of the impregnated pitches prepared in Examples 1~13 were calculated based on ASTM D4530.

The measured QI value and carbonization yield of each impregnated pitch are shown in Table 2.

TABLE 2

| | Step 1 (pressurization) | | | Step 2 (normal pressure) | | | Step 3 (reduced pressure) | | | | carbonization |
|---|---|---|---|---|---|---|---|---|---|---|---|
| | pressure (Bar) | temperature (° C.) | time (H) | pressure (Bar) | temperature (° C.) | time (H) | pressure (Bar) | temperature (° C.) | time (H) | QI (%) | yield (%) |
| Example 1 | 15 | 370 | 3 | 1 | 370 | 3 | 0 | 200 | 1 | 0.00 | 51.3 |
| Example 2 | | 330 | 3 | | 370 | 3 | | 200 | 1 | 0.01 | 48.2 |
| Example 3 | | 410 | 3 | | 370 | 3 | | 200 | 1 | 1.54 | 54.6 |
| Example 4 | | 370 | 1 | | 370 | 3 | | 200 | 1 | 0.00 | 47.9 |
| Example 5 | | 370 | 5 | | 370 | 3 | | 200 | 1 | 0.52 | 52.1 |
| Example 6 | | 370 | 3 | | 330 | 3 | | 200 | 1 | 0.05 | 47.4 |
| Example 7 | | 370 | 3 | | 410 | 3 | | 200 | 1 | 1.89 | 53.1 |
| Example 8 | | 370 | 3 | | 370 | 1 | | 200 | 1 | 0.00 | 49.1 |
| Example 9 | | 370 | 3 | | 370 | 5 | | 200 | 1 | 0.78 | 52.6 |
| Example 10 | | 370 | 3 | | 370 | 3 | | 170 | 1 | 0.00 | 49.3 |
| Example 11 | | 370 | 3 | | 370 | 3 | | 230 | 1 | 0.11 | 51.9 |
| Example 12 | | 370 | 3 | | 370 | 3 | | 200 | 2 | 0.15 | 51.7 |
| Example 13 | | 370 | 3 | | 370 | 3 | | 200 | 0.5 | 0.00 | 49.7 |

As shown in Table 2, the impregnated pitches prepared in every example according to the method of the present invention demonstrated a low QI value (2% or less) and a high carbonization yield (45% or more).

Therefore, when an impregnated pitch is prepared from a petroleum-based raw material using the method for producing an impregnated pitch according to the present invention, it is possible to produce an W impregnated pitch having a low QI value and a high carbonization yield at the same time.

What is claimed is:

1. A method for producing an impregnated pitch comprising the following steps:

heat-treating a petroleum-based raw material in an inert gas atmosphere under the pressure of 10~40 bar (step 1);

heat-treating the petroleum-based raw material which had been heat-treated in step 1 at normal pressure (step 2); and distillating the petroleum-based raw material which had been heat-treated in step 2 under reduced pressure (step 3).

2. The method for producing an impregnated pitch according to claim 1, wherein the heat-treatment in step 1 is performed in a temperature range of 300° C. to 450° C.

3. The method for producing an impregnated pitch according to claim 1, wherein the heat-treatment in step 1 is performed for 0.5~10 hours.

4. The method for producing an impregnated pitch according to claim 1, wherein the heat-treatment in step 2 is performed in a temperature range of 300° C. to 450° C.

5. The method for producing an impregnated pitch according to claim 1, wherein the heat-treatment in step 2 is performed for 0.5~10 hours.

6. The method for producing an impregnated pitch according to claim 1, wherein the distillation under reduced pressure in step 3 is performed in a temperature range of 100° C. to 250° C.

7. The method for producing an impregnated pitch according to claim 1, wherein the distillation under reduced pressure in step 3 is performed for 0.5~10 hours.

8. The method for producing an impregnated pitch according to claim 1, wherein the inert gas is one or more gases selected from the group consisting of nitrogen, helium, neon or argon.

9. The method for producing an impregnated pitch according to claim 1, wherein the petroleum-based raw material is one or more materials selected from the group consisting of pyrolyzed fuel oil (PFO), naphtha cracking bottom oil (NCB), ethylene cracker bottom oil (EBO), vacuum residue (VR), de-asphalted oil (DAO), atmospheric residue (AR), FCC-DO (fluid catalytic cracking decant oil), RFCC-DO (residue fluid catalytic cracking decant oil) and heavy aromatic oil.

* * * * *